US006402061B1

(12) United States Patent
Fukutomi et al.

(10) Patent No.: US 6,402,061 B1
(45) Date of Patent: Jun. 11, 2002

(54) FUEL INJECTION VALVE

(75) Inventors: Norihisa Fukutomi; Masayuki Aota; Osamu Matsumoto, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 8 days.

(21) Appl. No.: 09/653,205

(22) Filed: Aug. 31, 2000

(51) Int. Cl.[7] ..... B05B 1/30

(52) U.S. Cl. ..... 239/585.1; 239/585.5; 239/463

(58) Field of Search ..... 239/463, 472, 239/491, 492, 493, 494, 533.1, 533.2, 533.12, 585.1, 585.4, 585.5

(56) References Cited

U.S. PATENT DOCUMENTS 5,190,221 A 3/1993 Reiter
5,570,841 A * 11/1996 Pace et al. ..... 239/585.1
5,871,157 A 2/1999 Fukutomi et al. ..... 239/463
6,015,103 A * 1/2000 Kotkowicz ..... 239/585.4
6,024,302 A * 2/2000 Sumida et al. ..... 239/585.5

FOREIGN PATENT DOCUMENTS

| | | | |
|---|---|---|---|
| DE | 19907899 | 8/2000 | |
| JP | 8-210217 | 8/1996 | ..... F02M/51/08 |
| JP | 9-324722 | 12/1997 | ..... F02M/51/06 |
| JP | 2774153 | 4/1998 | ..... F16K/31/06 |

OTHER PUBLICATIONS

Patent Abstracts of Japan, vol. 1998, No. 04, Mar. 31, 1998.

* cited by examiner

*Primary Examiner*—Lisa A. Douglas
(74) *Attorney, Agent, or Firm*—Sughrue Mion, PLLC

(57) ABSTRACT

Step portions in a core and a valve holder are provided, and an L-shaped sleeve is fitted in these step portions. This construction axially shortens the coextensive portion of the outer circumference of the armature and the inner circumference of the sleeve. The length of the armature is also relatively shortened.

13 Claims, 8 Drawing Sheets

PRIOR ART

FUEL INJECTION VALVE

BACKGROUND OF THE INVENTION

This invention relates to a fuel injection valve mainly used in an engine for vehicle.

FIG. 7 is a sectional side view showing a conventional fuel injection valve disclosed in, for example, the Unexamined Japanese Patent Application Publication No. Hei 9-324722. In FIG. 7, numeral 31 is a body, and numeral 32 is a hollow cylindrical-shaped sleeve welded after a press fit in the top end of the body 31, and in the upper half of the sleeve 32, the bottom of a tubular core 33 made of magnetic materials is welded after a press fit. Numeral 34 is a bobbin, and numeral 35 is a solenoid coil wound on the bobbin 34, and numeral 36 is a shaft-shaped valve, and numeral 37 is an armature.

Further, FIG. 8 is a sectional side view showing a conventional injection valve disclosed in the Japanese Patent No. 2774153. In FIG. 8, numeral 38 is a core, and numeral 39 is an electromagnetic coil, and numeral 40 is a case, and numeral 41 is an armature, and numerals 42 and 43 are valve bodies, and numeral 44 is a valve seat, and numeral 45 is a valve element, and numeral 46 is a sleeve which has a cylinder portion formed in two steps and is a structure in which a stopper is not placed, and the sleeve 46 is formed in double cylinder shape.

In the conventional examples described above, for both the examples, a sectional area of a portion along the core of the sleeve was not controlled and a section thickness of the sleeve was determined in consideration of only the structural strength of the sleeve. Also, the sectional area of the portion along the core of the sleeve is obviously more than or equal to ½ of the sectional area of the core.

Further, for both the examples, the sleeve was manufactured by cutting.

The conventional fuel injection valves are constructed as described above and in the example shown in the Unexamined Japanese Patent Application Publication No. Hei 9-324722, the sleeve is formed in a hollow cylindrical shape, so that an axial length of the armature becomes long and the armature weight becomes heavy. Particularly in the case of a fuel injection valve for cylinder injection, the armature operates under high fuel pressure, so that a large electromagnetic attraction force is required and a side area of the armature needs to be increased, but a length of the armature needs to be lengthened in the case that sleeve is a hollow cylindrical shape, so that the armature weight becomes heavier.

An increase in the armature weight reduces a response of a needle valve and it becomes difficult to ensure a wide flow control range necessary to the fuel injection valve for cylinder injection.

Also, an increase in the needle valve weight increases the occurrence of sound caused by a collision between the end surface of the armature and the end surface of the core and between the top end of the needle valve and the valve seat in the case of opening and closing the needle valve, and this adversely affects noise of a car.

Also, in the Japanese Patent No. 2774153, the sleeve 46 with the cylinder portion formed in two steps has not such a problem described above, but a large inner diameter portion of the sleeve 46 is in contact with an outer diameter portion of the valve body 43, so that a magnetic path detours and the energy loss due to an increase in reluctance occurs. Also, in the lower side of FIG. 8 from the large inner diameter portion of the sleeve 46, the case 40 is constructed so as to make contact with the outside of the valve body 42, so that the outer diameter of this portion increases.

Further, since there is no stopper, an air gap which is a gap between the core and the armature cannot be adjusted, and open time and close time of a solenoid valve cannot be properly adjusted. In a conventional method, the amount equivalent to -this air gap is adjusted by a film thickness of surface treatment of the core and the armature, but a thickness setting range of the film thickness is narrow, and the film thickness changes with time due to wear caused by the collision between the core and the armature.

Furthermore, in the needle valve when opening the valve, the inclination becomes large according to squareness of the core end surface, so that a flow passage sectional area between the valve seat and the top end of the needle valve becomes non-uniform, with the result that spray shapes of fuel vary with products.

Also, there was a problem that a sectional area of a portion along a magnetic path of the sleeve in which an eddy current occurs is large and the occurrence of the eddy current is large and the cost increases.

Further, since the sleeve is conventionally manufactured by cutting processing, there was a problem that it is difficult to make the section thickness to 0.5 mm or less in case that deformation in the processing intends to be not caused and the section thickness becomes thick and thus an outer diameter of a product increases.

SUMMARY OF THE INVENTION

The invention is implemented to solve such problems, and it is an object of the invention to reduce a weight of a valve by shortening a length of an armature and increase control accuracy and a control range of a fuel flow by an improvement in response and further decrease operating noise.

A fuel injection valve according to aspect 1 of the invention comprises a valve body coupled to a valve holder, a valve seat which is provided in this valve body and has an orifice, a valve element for separably contacting with this valve seat to open or close the orifice, an armature integrally formed with this valve element, and a coil for forming a magnetic circuit by this armature, a core and a yoke, and further step portions are provided in the core and the valve holder and an L-shaped sleeve fitted in these step portions is provided.

In the fuel injection valve according to aspect 2 of the invention, a stopper is provided between the valve holder and the valve body.

In the fuel injection valve according to aspect 3 of the invention, a sectional area of a portion along the core of the sleeve is less than or equal to ½ of a sectional area of the core.

In the fuel injection valve according to aspect 4 of the invention, a rib for structural reinforcement is provided in a corner portion of the L shape of the sleeve.

In the fuel injection valve according to aspect 5 of the invention, the sleeve is formed of a non-magnetic material with an electrical resistivity of 70 $\mu\Omega\cdot$cm or more and a permeability of $20\times10^{-7}$ h/m or less at 23° C.

In the fuel injection valve according to aspect 6 of the invention, the sleeve is manufactured of a plate material by plastic deformation.

In the fuel injection valve according to aspect 7 of the invention, the sleeve is manufactured by metal injection molding.

DETAILED DESCRIPTION OF THE PREFERRED EMBODIMENTS

First Embodiment

Figure 1:
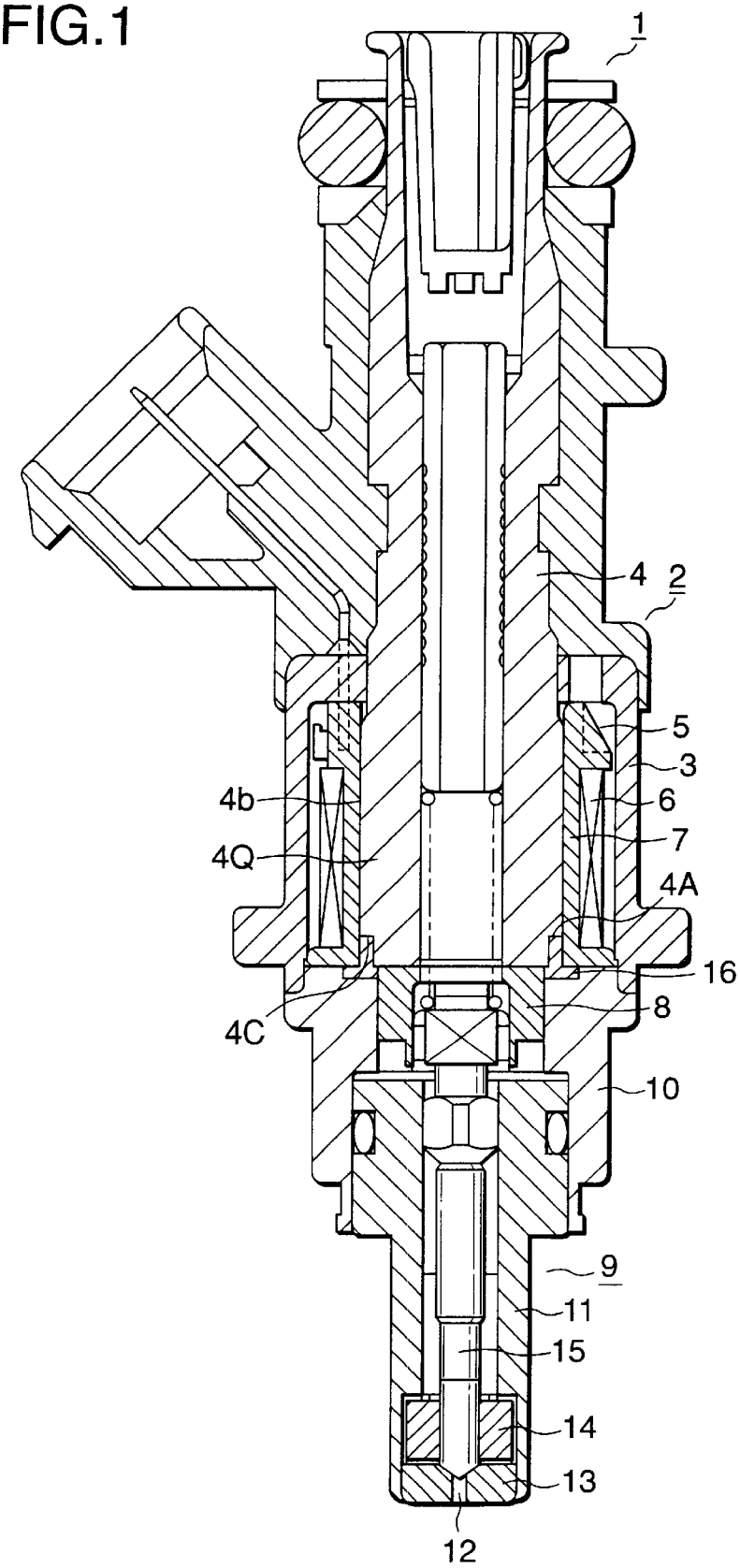
FIG. 1 is a sectional side view showing a fuel injection valve according to a first embodiment of this invention.

FIG. 1 is a sectional side view showing a fuel injection valve according to a first embodiment of the invention. In FIG. 1, numeral 1 is a fuel injection valve for cylinder injection, and numeral 2 is a solenoid, and numeral 3 is a yoke, and numeral 4 is a core, and numeral 5 is a coil assembly, and numeral 6 is a coil, and numeral 7 is a bobbin, and numeral 8 is an armature, and numeral 9 is a valve unit and this valve unit 9 is coupled to one end of a valve holder 10 by means such as welding.

The valve unit 9 comprises a hollow cylindrical-shaped valve body 11 with an outer diameter portion formed in two steps, a valve seat 13 which is fixed in the top of a center hole within the valve body 11 and has an orifice 12, a swirler 14 which is placed between the valve seat 13 and the valve body 11 and applies a swing flow to injection fuel, and a needle valve (valve element) 15 which is a valve mechanism for separably contacting with the valve seat 13 by the solenoid 2 to open or close the orifice 12.

In solenoid 2, a sleeve 16 made of metal is placed between the core 4 and the valve holder 10, and the sleeve 16 is respectively coupled Lo the core 4 and the valve holder 10 by means such as welding; and this coupling means functions as sealing of internal fuel. The sleeve 16 is axially connected to the core 4 at a step portion 4A of a large diameter portion 4*b* and a small diameter portion 4*c* of the core 4, and an axial position of the core 4 is determined.

Next, operations will be described. When the coil 6 is energized, a magnetic flux occurs in a magnetic circuit formed by the armature 8, the core 4 and the yoke 3, and the armature 8 is attracted to the side of the core 4, and when the needle valve 15 integrally formed with the armature 8 breaks contact with the valve seat 13 to form a gap, fuel of high pressure flows from the valve body 11 into the orifice 12 of the valve seat 13 and is injected from the top outlet of the orifice 12 into a combustion chamber of an internal combustion engine.

In the invention, a sectional shape of the sleeve 16 is formed in an L shape, and when an area in which the armature 8 is opposite to an inner circumference of the valve holder 10 intends to be secured, a portion in which an outer circumference of the armature 8 is opposite to an inner circumference of the sleeve 16 is axially short, so that a length of the armature 8 can be relatively shortened.

Also, by providing the large diameter portion 4*b* in the core 4, an area of a magnetic path 4Q of the inner diameter side of the coil 6 which is the most convergence portion of the magnetic flux can be increased and a large electromagnetic attraction force is obtained.

Figure 2:
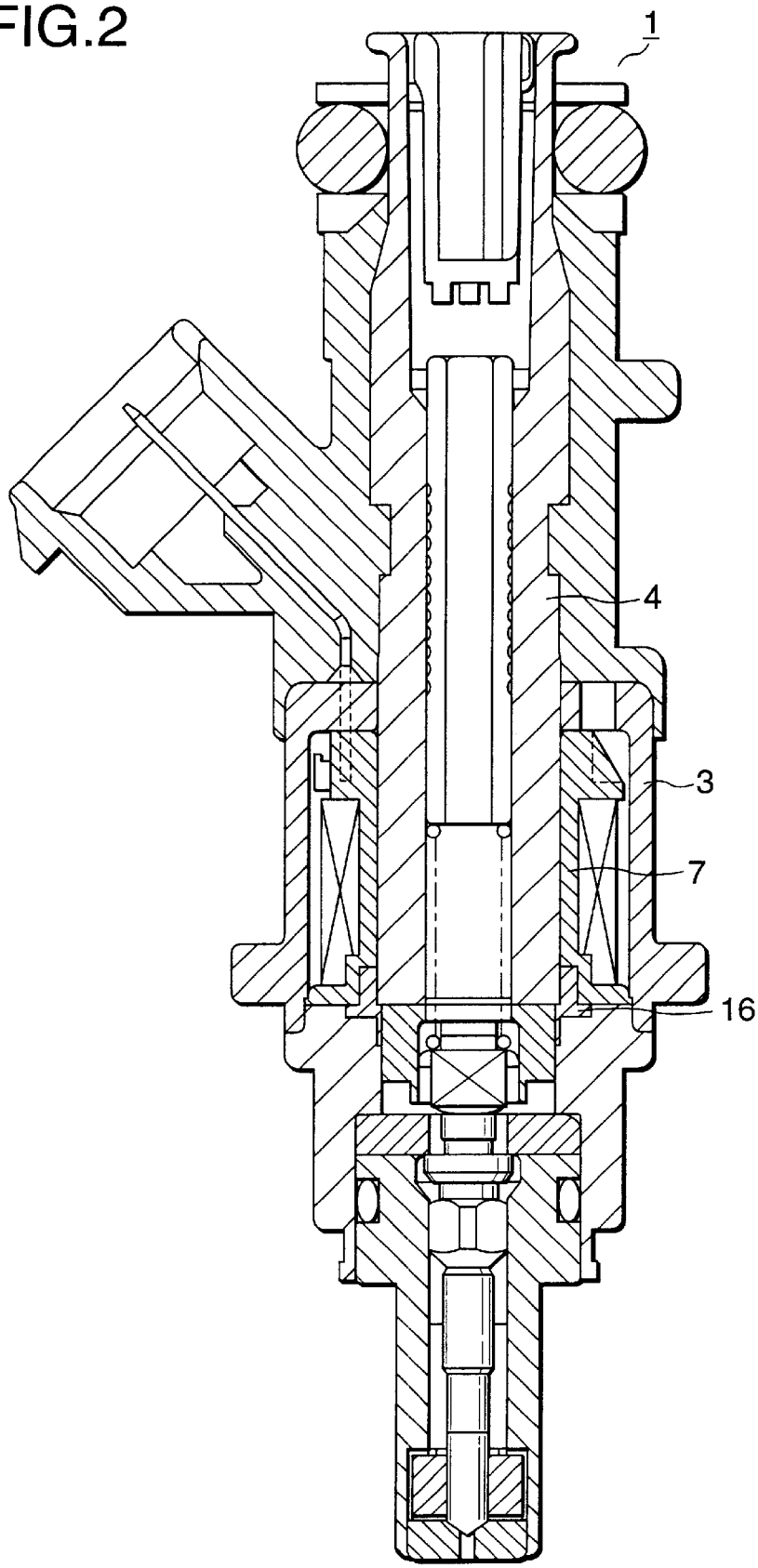
FIG. 2 is a sectional side view illustrating the fuel injection valve according to the first embodiment of the invention.

That is, in the case of a straight shape of the small diameter portion 4*c* as shown in FIG. 2 without providing the large diameter portion in the core 4, the magnetic path area of the inner diameter side of the coil 6 becomes narrow and there is a disadvantage in an attraction force. On the contrary, it is contemplated to increase the number of windings of the coil 6 to strengthen the attraction force by the decrease in the diameter of the core 4, but the increase in the number of windings of the coil delays responses of a rise and a fall in the attraction force, so that a response of the needle valve 15 is delayed.

By the construction as described above, a response by weight reduction of the armature 8 is improved and accordingly a control range of an injection fuel quantity is increased. Further, by the weight reduction of the armature 8, wear in the valve is reduced and accordingly life is increased; and also operating noise is reduced and accordingly driverability of a car can be improved.

Second Embodiment

Figure 3:
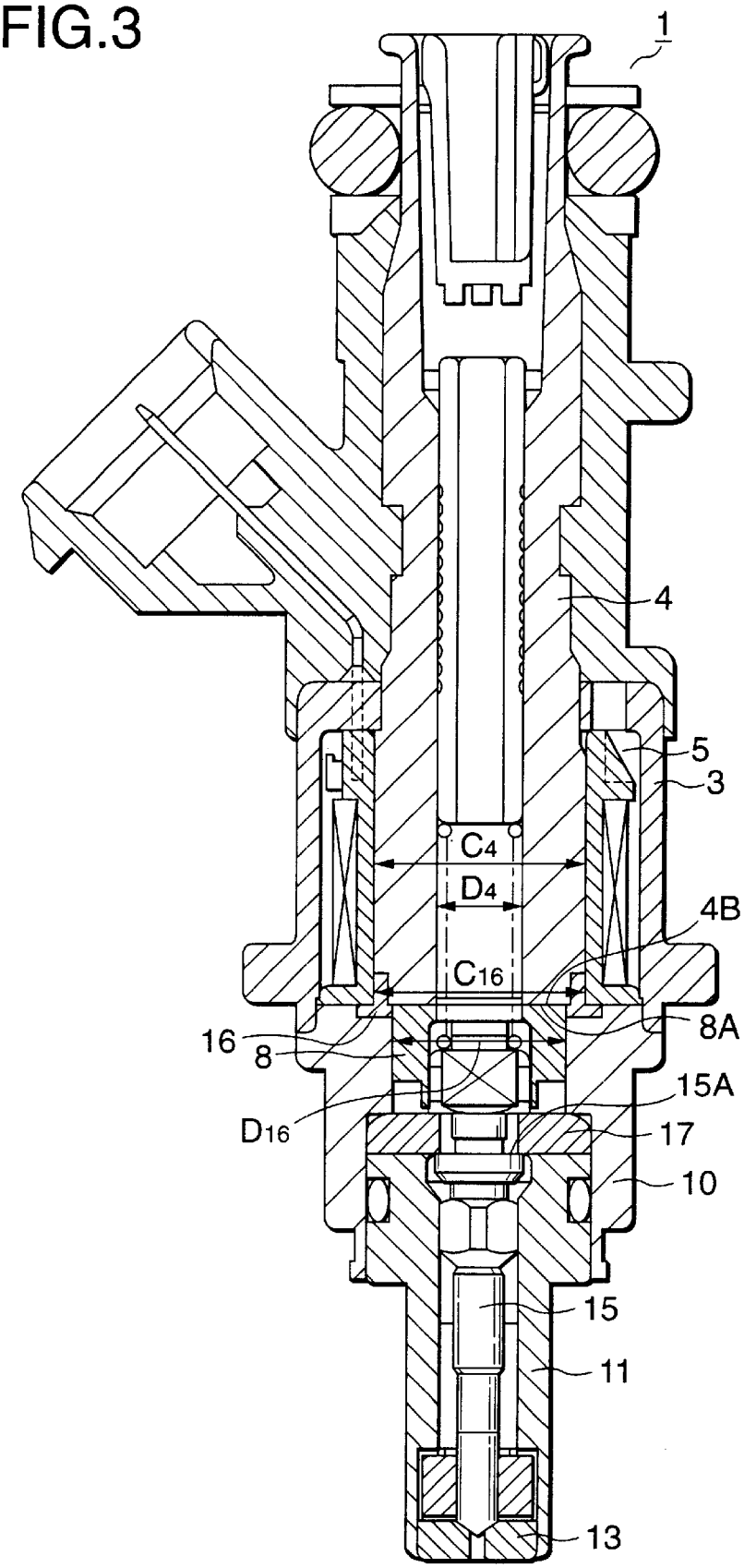
FIG. 3 is a sectional side view showing a fuel injection valve according to a second embodiment of the invention.

FIG. 3 is a sectional side view showing a fuel injection valve according to a second embodiment of the invention. In the embodiment, a stopper 17 is disposed between the valve holder 10 and the valve body 11. When the needle valve 15 is opened, a step portion 15A of the needle valve 15 makes contact with the stopper 17 and an angle of inclination in an opening state of the needle valve 15 can be determined, so that the inclined angle of the needle valve 15 to the valve seal 13 is small and variations in spray shape with products decreases.

Also, by properly selecting a thickness of the stopper 17, an adjustment margin of a distance (air gap) between a core end surface 4B and an armature end surface 8A in the case of opening the valve can be largely provided, so that a response of the needle valve 15 can be optimally adjusted and even in case of changing use conditions of the fuel injection valve (for example, fuel pressure), provisions can be made by only changing a design value of the air gap without a change in structure.

By the construction as described above, the air gap (between 8A and 4B) could be adjusted, and the optimal setting of time for opening and closing the valve could be made. Accordingly, the control range of the injection fuel quantity could be easily increased.

Also, an inclination in the case of opening the needle valve 15 became small and non-uniformity in flow near the fuel outlet was decreased and accordingly, product variations in the injection fuel quantity and the spray shape were reduced.

Third Embodiment

Further, it may be constructed so that a sectional area of a portion along the core 4 of the sleeve 16 is less than or equal to ½ of a sectional area of the core 4. As a result of this, a magnetic delay due to an eddy current decreases and response time of the needle valve 15 can be sped up, so that the control range of the injection fuel quantity can be increased.

That is, in FIG. 3, in case where $C_4$ is a core outer diameter and $D_4$ is a core inner diameter and $C_{16}$ is a sleeve outer diameter and $D_{16}$ is a sleeve inner diameter and $S_4$ is a core sectional area and $S_{16}$ is a sleeve sectional area, $S_4=\pi/4(C_4^2-D_4^2)$ and $S_{16}=\pi/4(C_{16}^2-D_{16}^2)$ and here, it is constructed so that the ratio between the sectional areas is $S_{16}/S_4 \leqq ½$.

Fourth Embodiment

Figure 4:
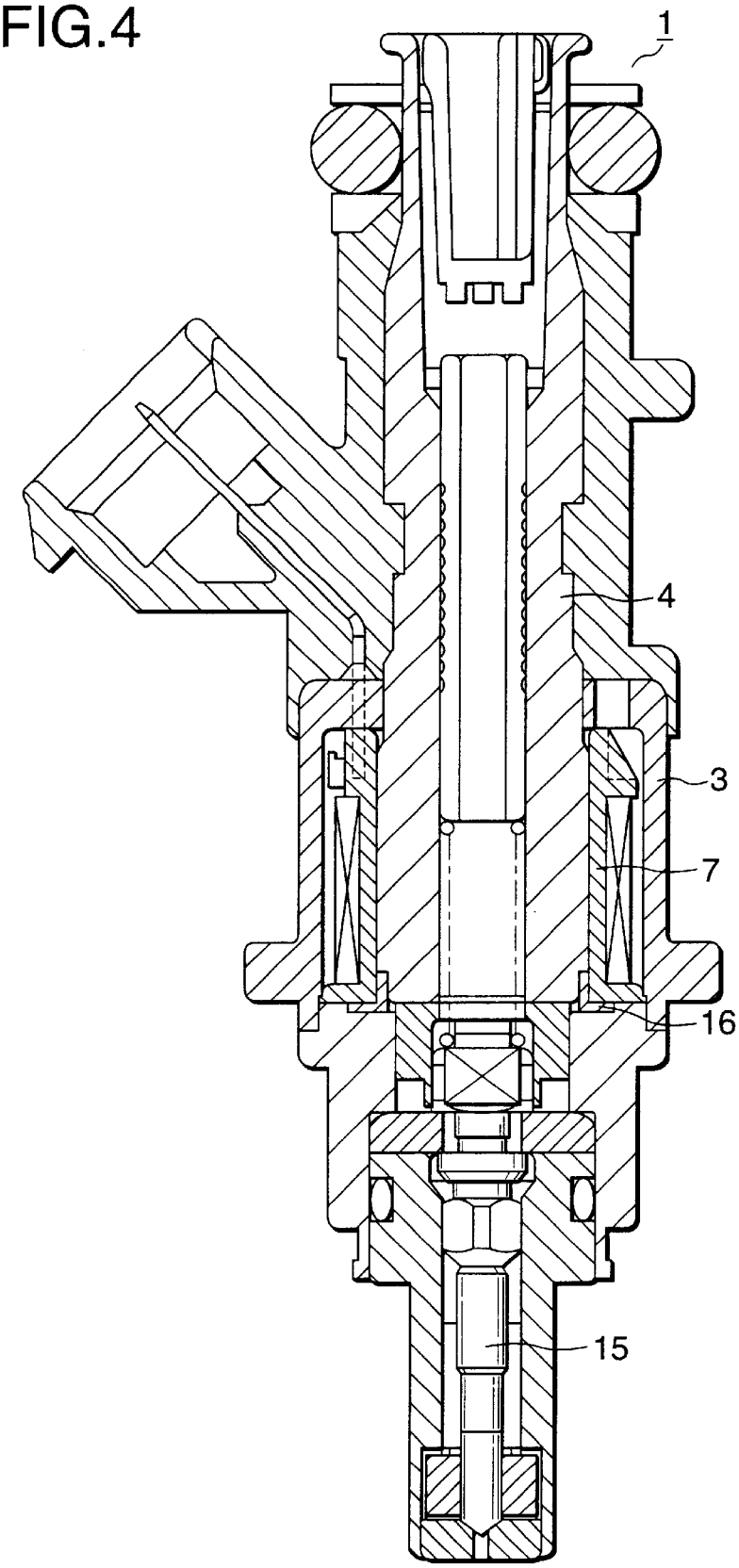
FIG. 4 is a sectional side view showing a fuel injection valve according to a fourth embodiment of the invention.

FIG. 4 is a sectional side view showing a fuel injection valve according to a fourth embodiment of the invention. In FIG. 4, the sleeve 16 may be processed and manufactured of a plate material by plastic deformation. As a result of this, manufacturing costs of the sleeve 16 is reduced, and further the plate material is used, so that a section thickness can be made thinner than that of a cut product as shown in FIG. 4, and the ratio of the sectional area of the sleeve 16 to the sectional area of the core 4 can be decreased, so that the response of the needle valve 15 can be sped up.

Fifth Embodiment

Figure 5:
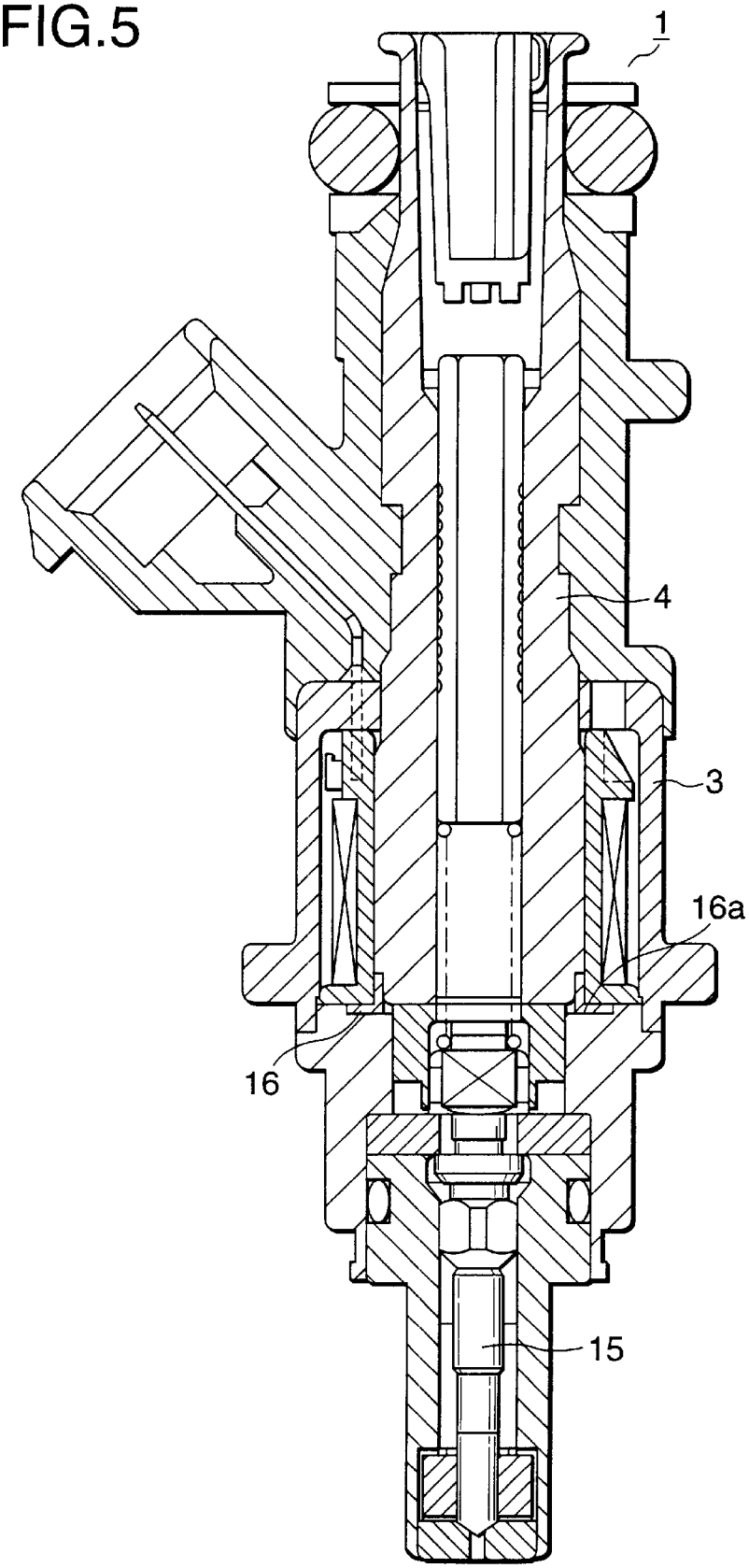
FIG. 5 is a sectional side view showing a fuel injection valve according to a fifth embodiment of the invention.

FIG. 5 is a sectional side view showing a fuel injection valve according to a fifth embodiment of the invention, and in the embodiment, the sleeve 16 is processed and manufactured of a plate material by plastic deformation and further a rib (stepped portion) 16*a* for strurtural reinforcement is provided in a corner portion of the L-shaped sleeve 16. Then, the rib 16*a* is provided in only all the circumference or a partially circumferential range of the sleeve 16. An example of providing the rib 16*a* in only the partially circumferential range is shown in FIG. 5. By the formation of such a shape, a strength (stiffness) increases compared with the L-shaped sleeve 16.

As described above, the rib 16*a* for structural reinforcement is provided in a portion of the sleeve 16 of sheet metal, so that structural stability of the sleeve 16 was improved, and a margin (reliability) for preventing poor fuel sealing due to a change in performance and breakage of coupled portions was improved in relation to deformation in the case of using high fuel pressure or deformation in the case of manufacturing by assembly.

Also, by using the sleeve 16 of sheet metal, a radial reduction in internal dimension of the fuel injection valve was implemented and a size of the fuel injection valve was reduced, so that engine mountability necessary for a cylinder injection valve was improved.

Sixth Embodiment

Figure 6:
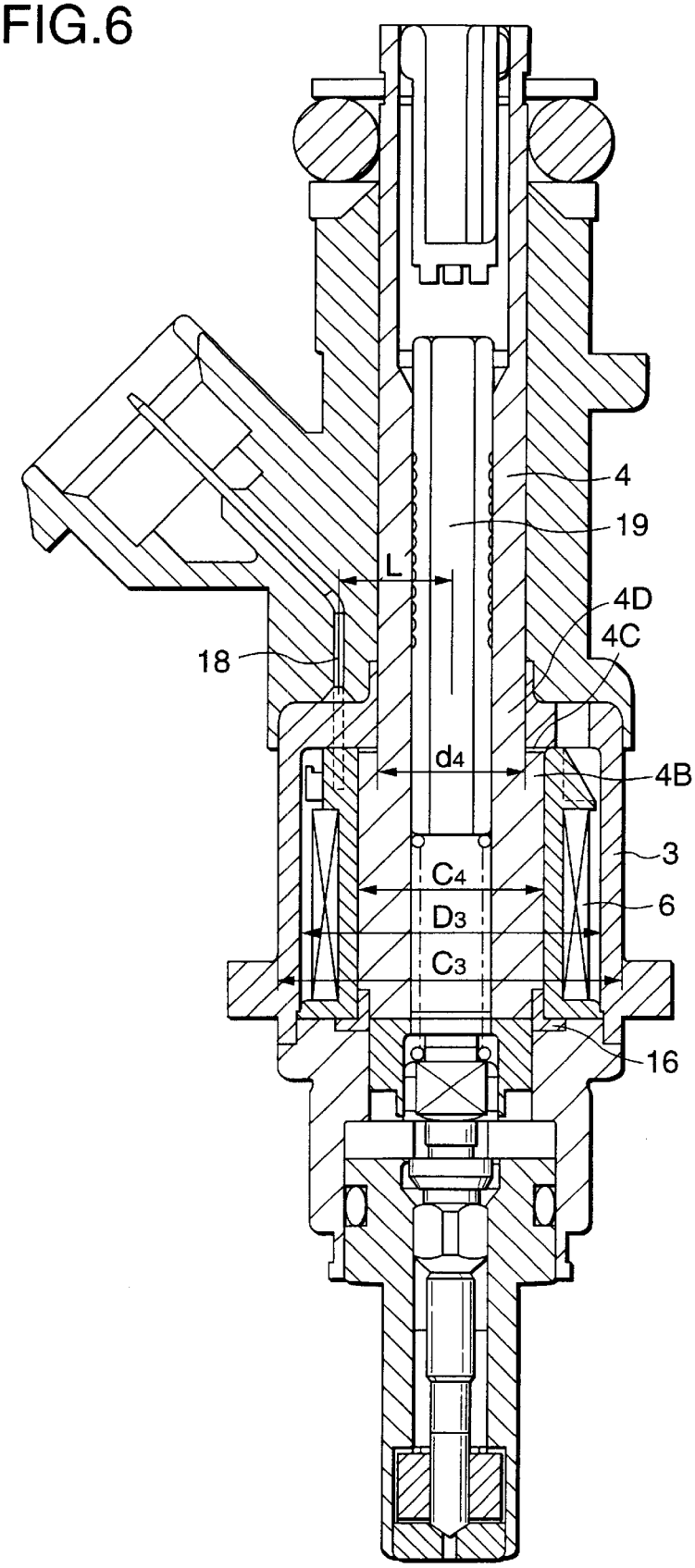
FIG. 6 is a sectional side view showing a fuel injection valve according to a sixth embodiment of the invention.
Figure 7:
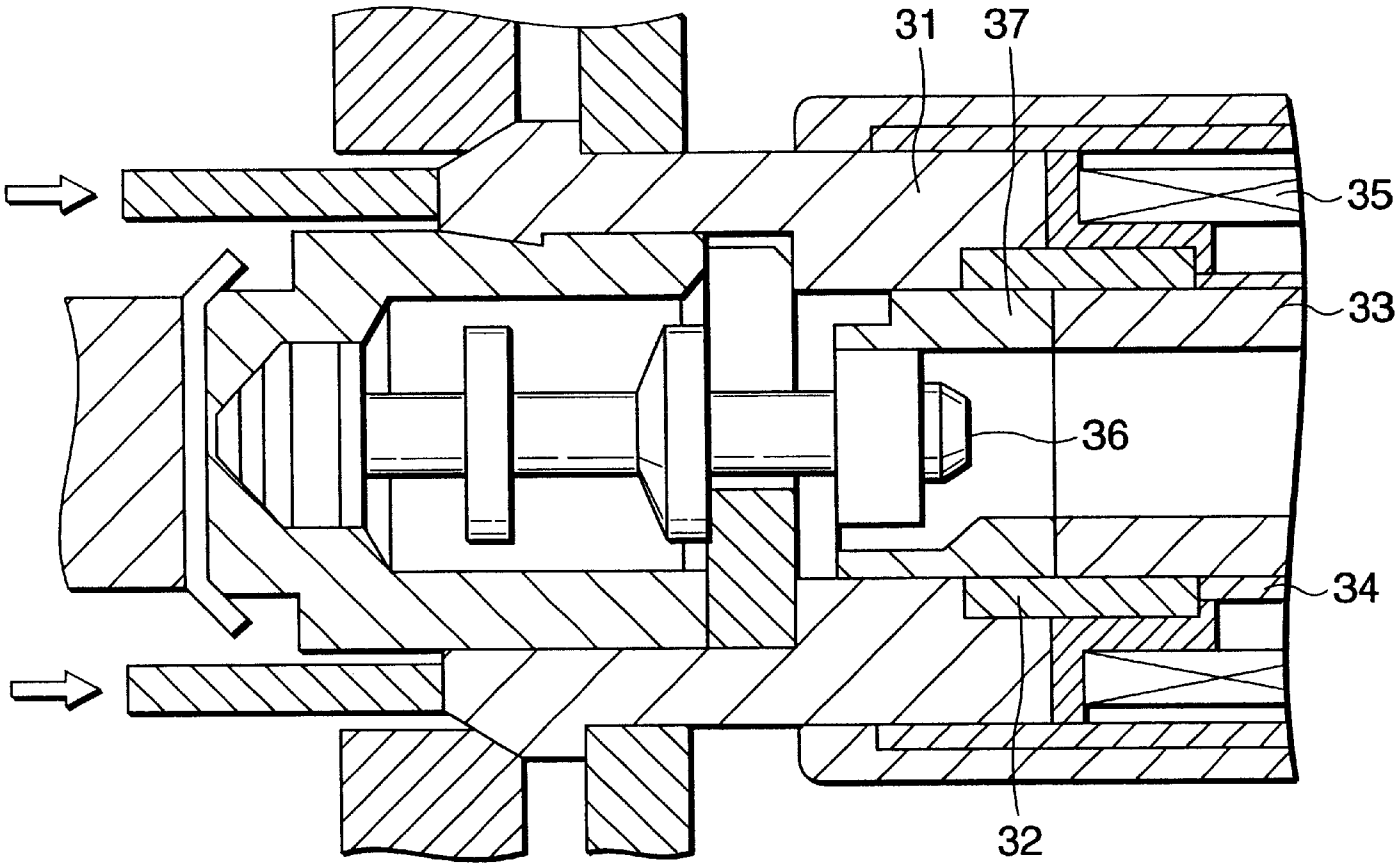
FIG. 7 is a sectional side view showing a conventional fuel injection valve.
Figure 8:
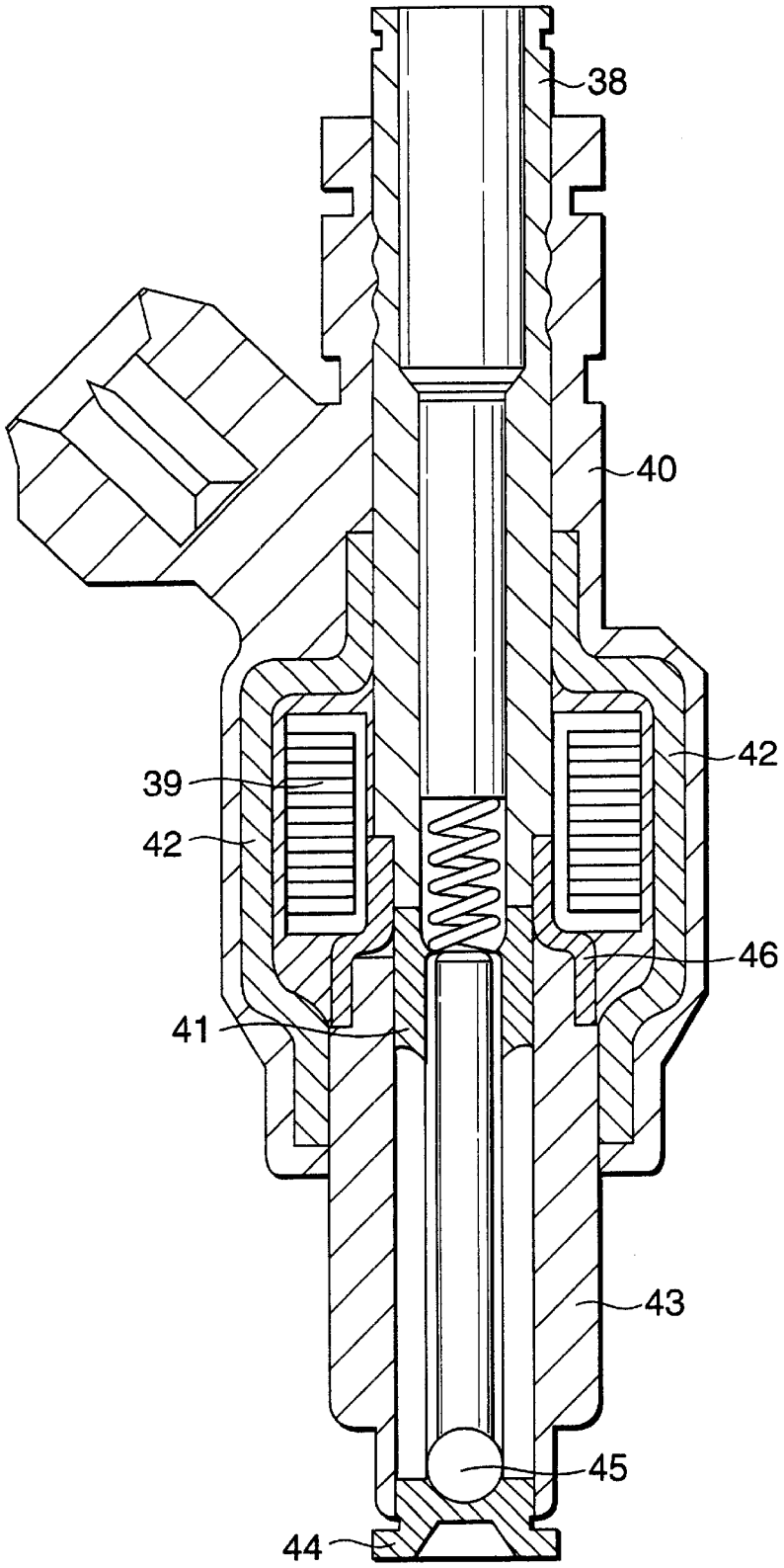
PRIOR ART FIG.8
FIG. 8 is a sectional side view showing a conventional fuel injection valve.

FIG. 6 is a sectional side view showing a fuel injection valve according to a sixth embodiment of the invention, and it is constructed so that a step portion 4B is provided in the core 4 and a core outer diameter $d_4$ of this portion is made smaller than $C_4$ and a distance L between a terminal 18 and a shaft center of the fuel injection valve is reduced compared with the embodiments described above. As a result of this, a yoke inner diameter $D_3$ also becomes small, so that a yoke outer diameter $C_3$ also becomes small and a size of the fuel injection valve can be reduced.

Incidentally, for the coil 6, a winding position moves to the shaft center side of the fuel injection valve by thinning a section thickness of the sleeve 16 compared with the first to fourth embodiments, so that provisions can be made for a reduction in the yoke inner diameter $D_3$.

Also, by providing the step portion 4B, a gap 4C occurs and a magnetic path by the core 4 decreases. That is, a problem that a magnetic path sectional area of a core neck portion 4D becomes smaller than that of an air gap portion to reduce the number of magnetic fluxes arises. Thus, by forming a rod 19 of a magnetic material, the magnetic path sectional area is ensured using the rod 19 as a parallel magnetic path and a magnetic performance reduction can be avoided.

Also, as material of the sleeve 16, a non-magnetic material with an electrical resistivity of 70 $\mu\Omega$·cm or more and a permeability of $20\times10^{-7}$ h/m or less at a sleeve temperature of 23° C. may be used. As a result of this, the response delay of magnetism due to the eddy current occurring in the sleeve 16 can be made within tolerance limits, and response time of the needle valve 15 becomes fast and the control range of the injection fuel quantity can be increased.

Further, by manufacturing the sleeve 16 by metal injection molding, cost reduction and accuracy securement can be implemented.

According to a fuel injection valve of aspect 1 of the invention, the fuel injection valve comprises a valve body coupled to a valve holder, a valve seat which is provided in this valve body and has an orifice, a valve element for separably contacting with this valve seat to open or close the orifice, an armature integrally formed with this valve element, and a coil for forming a magnetic circuit by this armature, a core and a yoke, and further step portions are provided in the core and the valve holder and an L-shaped sleeve fitted in these step portions is provided, so that a response by weight reduction of the armature can be improved and accordingly a control range of an injection fuel quantity can be increased.

According to the fuel injection valve of aspect 2 of the invention, a stopper is provided between the valve holder and the valve body, so that an air gap can be adjusted and the optimum setting of time for opening and closing a valve can be made.

According to the fuel injection valve of aspect 3 of the invention, a sectional area of a portion along the core of the sleeve is less than or equal to ½ of a sectional area of the core, so that a magnetic delay due to an eddy current decreases and the control range of the injection fuel quantity can be increased.

According to the fuel injection valve of aspect 4 of the invention, a rib for structural reinforcement is provided in a corner portion of the L shape of the sleeve, so that structural stability of the sleeve can be improved.

According to the fuel injection valve of aspect 5 of the invention, the sleeve is formed of a non-magnetic material with an electrical resistivity of 70 $\mu\Omega$·cm or more and a permeability of $20\times10^{-7}$ h/m or less at 23° C., so that the magnetic delay due to the eddy current decreases and also, response time of the valve element becomes fast and the control range of the injection fuel quantity can be increased.

According to the fuel injection valve of aspect 6 of the invention, the sleeve is manufactured of a plate material by plastic deformation, so that thickness thinning impossible for cutting processing is implemented and an improvement in response by a reduction in a sectional area of a magnetic path can be implemented at a low cost.

According to the fuel injection valve of aspect 7 of the invention, the sleeve is manufactured by metal injection molding, so that accuracy close to the cutting processing can be ensured and manufacturing costs can be reduced.

What is claimed is:

1. A fuel injection valve comprising:

a valve body coupled to a valve holder, a valve seat which is provided in said valve body and has an orifice, a needle valve inserted in a hollow of said valve body, and separably contacting with said valve seat to open or close the orifice, an armature integrally formed with said needle valve; and a coil for forming a magnetic circuit by said armature, a core and a yoke, wherein step portions are provided in said core and said vale holder, and an L-shaped sleeve is fitted in said step portions.

2. The fuel injection valve as defined in claim 1, further comprising:

a stopper provided between said valve holder and said valve body, and a step portion provided on said needle valve and for contacting with said stopper when said orifice is opened.

3. The fuel injection valve as defined in claim 1, wherein a sectional area of a portion along said core of said sleeve is less than or equal to ½ of a sectional area of said core.

4. The fuel injection valve as defined in claim 1, further comprising:

a rib for structural reinforcement in a comer portion of the L-shape of said sleeve.

5. The fuel injection valve as defined in claim 1, wherein said sleeve is formed of a non-magnetic material with an electrical resistivity of 70 $\mu\Omega\cdot$cm or more and a permeability of $20\times10^{-7}$ h/m or less at 23° C.

6. The fuel injection valve as defined in claim 1, wherein said sleeve is manufactured of a plate material by plastic deformation.

7. The fuel injection valve as defined in claim 1, wherein said sleeve is manufactured by metal injection molding.

8. A fuel injection valve comprising:

a core of cylindrical shape having a first step portion at one end thereof;

a valve holder having a hollow an d having a second step portion at one end thereof;

a L-shaped sleeve fitted in said first and second step portions and respectively coupled to said core and said valve holder;

a valve body having a hollow and couple d to an inner circumference of said valve holder;

a valve seat provided in said hollow of said valve body and having an orifice at the center thereof;

a coil circumferentially surrounding said core and generating magnetic flux;

an armature inserted in said hollow of said valve holder, placed between said core and said valve body and attracted to said core when said magnetic flux is generated; and a needle valve inserted in a hollow of said valve body, extending along an axis of said valve body, coupled to said armature and separably contacting with said valve seat to open or close said orifice.

9. The fuel injection valve according to claim 8, further comprising:

a stopper provided between said valve holder and said valve body, and a step portion provided on said needle valve and for contacting with said stopper when said orifice is opened.

10. The fuel injection valve according to claim 8, further comprising:

a sectional area of a portion along said core of said sleeve is less than or equal to ½ of a sectional area of said core.

11. The fuel injection valve according to claim 8, further comprising:

a rib for structural reinforcement in a comer portion of the L-shape of said sleeve.

12. The fuel injection valve according to claim 8, wherein said sleeve is formed of a non-magnetic material with an electrical resistivity of 70 $\mu\Omega\cdot$cm or more and a permeability of $20\times10^{-7}$ h/m or less at 23° C.

13. A fuel injection valve comprising:

a core of cylindrical shape having a first step portion at one end thereof;

a valve holder having a hollow and having a second step portion at one end thereof;

a L-shaped sleeve fitted in said first and second step portions and respectively coupled to said core and said valve holder;

a valve body having a hollow and coupled to an inner circumference of said valve holder;

an valve seat provided in said hollow of said valve body and having an orifice at the center thereof;

a coil circumferentially surrounding said core and generating magnetic flux;

an armature inserted in said hollow of said valve holder, placed between said core and said valve body and attracted to said core when said magnetic flux is generated;

a stopper provided between said valve holder and said valve body; and a valve element for separably contacting with said valve seat to open or close said orifice and having a third step portion which contacts with said stopper when said orifice is opened.

* * * * *